US010329971B2

(12) United States Patent
Verner et al.

(10) Patent No.: US 10,329,971 B2
(45) Date of Patent: Jun. 25, 2019

(54) SLIDING CAMSHAFT BARREL POSITION SENSING

(71) Applicant: GM GLOBAL TECHNOLOGY OPERATIONS LLC, Detroit, MI (US)

(72) Inventors: Douglas R Verner, Sterling Heights, MI (US); Scot A Douglas, Howell, MI (US); Joseph J Moon, Beverly Hills, MI (US); Alexander Doss, West Bloomfield, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 109 days.

(21) Appl. No.: 15/451,706

(22) Filed: Mar. 7, 2017

(65) Prior Publication Data

US 2018/0258803 A1 Sep. 13, 2018

(51) Int. Cl.
*F01L 13/00* (2006.01)

(52) U.S. Cl.
CPC ..... *F01L 13/0042* (2013.01); *F01L 13/0036* (2013.01); *F01L 2013/0052* (2013.01); *F01L 2013/111* (2013.01); *F01L 2820/041* (2013.01)

(58) Field of Classification Search
CPC ..... F01L 13/0042; F01L 2820/041; F01L 2013/111; F01L 13/0036; F01L 2013/0052
See application file for complete search history.

(56) References Cited

U.S. PATENT DOCUMENTS

2007/0215079 A1* 9/2007 Boggess ..... F01L 1/053 123/90.15
2014/0303873 A1* 10/2014 Glugla ..... F01L 13/0036 701/103

FOREIGN PATENT DOCUMENTS

DE 102011056833 * 6/2013 ..... F01L 13/0036

* cited by examiner

*Primary Examiner* — Mark A Laurenzi
*Assistant Examiner* — Wesley G Harris

(57) ABSTRACT

A system and method for sensing a camshaft barrel position of a sliding camshaft includes at least one sliding camshaft having at least one camshaft barrel and at least one position shifting slot disposed in the at least one camshaft barrel. At least one actuator is provided for engaging the at least one position shifting slot on the rotating sliding camshaft and shifting position of the at least one camshaft barrel and at least one sensor is provided for detecting the shifted position of the at least one camshaft barrel wherein the camshaft barrel includes position identifying features.

14 Claims, 16 Drawing Sheets

SLIDING CAMSHAFT BARREL POSITION SENSING

TECHNICAL FIELD

The present invention generally relates to camshaft position sensing systems for an internal combustion engine, and more particularly relates to a system and method for direct sensing of a sliding camshaft barrel position based on barrel features.

BACKGROUND

Internal combustion engines include intake and exhaust valves that can be actuated by cams of at least one camshaft. In some configurations the camshafts are constructed with sliding camshaft lobes having at least one camshaft barrel. Each camshaft barrel is configured to select at least two shift positions per cylinder. The sliding camshaft lobes are rotationally locked but can move in the axial direction on a base shaft that is controlled and driven like a standard camshaft on the internal combustion engine.

At least one actuator unit is fixed on the internal combustion engine for displacing each of the sliding camshaft lobes. Particularly, at least one actuator pin of an actuator unit is operative to selectively engage displacement grooves arranged symmetrically opposite to each other on the periphery of the camshaft barrels of the sliding camshaft lobes. As the camshaft rotates, an actuator pin is selected to move into a displacement groove of the camshaft barrel which causes the sliding camshaft lobe to shift into a different axial position along the camshaft axis. When a sliding camshaft lobe shifts position, the intake and/or exhaust valves associated with it may be caused to actuate differently which in turn will cause the engine operation to be different.

To ensure the sufficient performance and reliability of engine operation it is important to know the state and position of the sliding camshaft lobes, particularly the camshaft barrels, over the full operating range of the engine. Thus, there is a need for a reliable means of determining the position of a sliding camshaft barrels at all times during engine operation.

BRIEF SUMMARY

One or more exemplary embodiments address the above issue by providing a system and method for sliding camshaft barrel position sensing. More particularly, disclosed are exemplary embodiments that relate to a system and method for direct sensing of a sliding camshaft barrel position based on barrel features.

According to an aspect of an exemplary embodiment, a system for direct sensing of a sliding camshaft barrel position based on barrel features includes at least one sliding camshaft having at least one camshaft barrel. Still another aspect as according to the exemplary embodiment includes at least one position shifting slot disposed in the at least one camshaft barrel. And another aspect includes at least one actuator for engaging the at least one position shifting slot and shifting position of the at least one camshaft barrel. And yet another aspect of the exemplary embodiment includes at least one sensor for detecting the shifted position of the at least one camshaft barrel.

Still another aspect of the exemplary embodiment wherein at least one sliding camshaft is an intake camshaft. And another aspect wherein at least one sliding camshaft is an exhaust camshaft. And a further aspect wherein the intake camshaft has two sliding lobes each having two camshaft barrels. Yet a further aspect wherein the exhaust camshaft has two sliding lobes barrels each having one camshaft barrel.

Another aspect in accordance with the exemplary embodiment wherein two actuators are used for shifting the position of the two intake camshaft sliding lobes. Still another aspect wherein two actuators are used for shifting the position of the two exhaust camshaft sliding lobes. And another aspect wherein the at least one sensor is a Hall Effect sensor.

Yet another aspect of the exemplary embodiment wherein the intake camshaft positions can be shifted between high lift, low lift and deactivated (also referred to as Active Fuel Management (AFM)) positions. And still another aspect in accordance with the embodiment wherein the exhaust camshaft position can be shifted between high lift and deactivated (AFM) positions.

Another aspect in accordance with a method for sensing camshaft barrel position of a sliding camshaft includes rotating at least one sliding camshaft having at least one camshaft barrel.

Still in accordance with the exemplary embodiment, the method includes activating at least one actuator for engaging at least one position shifting slot in the at least one camshaft barrel to shift position of the at least one camshaft barrel. Yet another aspect includes detecting the shifted position of the at least one camshaft barrel of the at least one sliding camshaft using at least one sensor.

And yet other aspects in accordance with the exemplary embodiment wherein detecting includes tracking features of the at least one camshaft barrel indicative of at least one of a high lift, low lift, or deactivated (AFM) camshaft barrel position.

Still another aspect of the exemplary embodiment wherein detecting includes tracking at least one position shifting slot of the at least one camshaft barrel that is indicative of at least one of a high lift, low lift, or deactivated camshaft barrel position. And further aspects wherein detecting includes using a Hall Effect sensor for tracking the at least one position shifting slot of the at least one camshaft barrel.

Yet further aspects in accordance with the exemplary embodiment also includes performing at least one remedial action when the at least one camshaft barrel remains in an unshifted position in response to activating at least one actuator. And yet another aspect wherein the remedial action is restoring at least one other camshaft barrel to the unshifted position of the at least one camshaft barrel.

Still another aspect further includes setting a fault code and service indicator lamp. And one other aspect wherein activating includes activating two actuators for shifting position of the at least one camshaft barrel. Yet a further aspect wherein rotating includes an intake sliding camshaft and an exhaust sliding camshaft.

And another aspect wherein detecting the shifted position of the intake sliding camshaft includes high lift, low lift, and deactivated positions. Still another aspect wherein detecting the shifted position of the exhaust camshaft includes high lift and deactivated positions.

BRIEF DESCRIPTION OF THE DRAWINGS

The present exemplary embodiment will hereinafter be described in conjunction with the following drawing figures, wherein like numerals denote like elements.

DETAILED DESCRIPTION

The following detailed description is merely exemplary in nature and is not intended to limit the embodiment or the application and uses thereof. Furthermore, there is no intention to be bound by any theory presented in the preceding background or the following detailed description.

Figure 1:
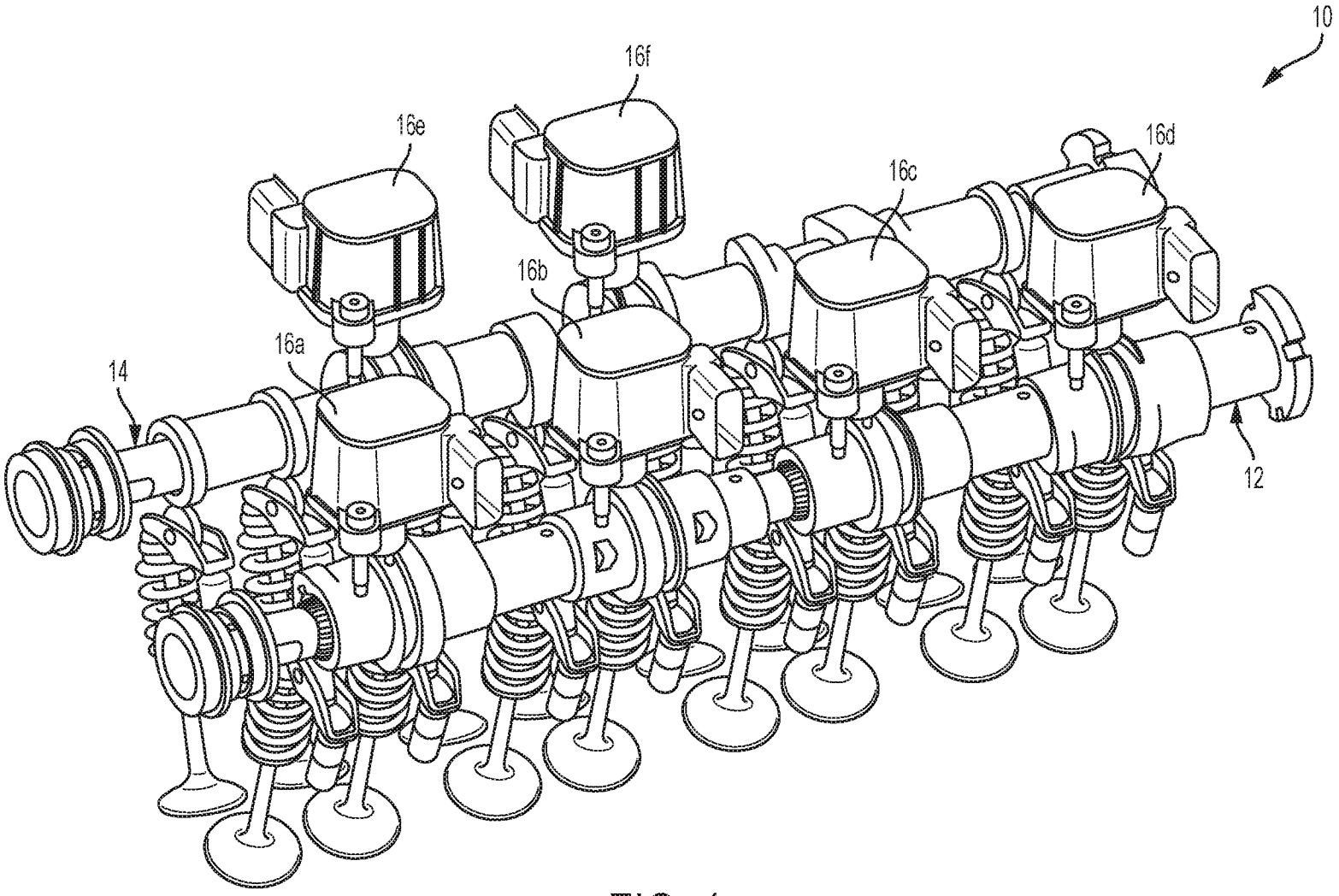
FIG. 1 is an illustration of an intake and an exhaust sliding camshaft configuration for a 4 cylinder internal combustion engine in accordance with aspects of an exemplary embodiment.

In accordance with the disclosed embodiment, FIG. 1 is an illustration of an intake and an exhaust sliding camshaft configuration for a 4 cylinder internal combustion engine 10 in accordance with aspects of an exemplary embodiment. It is appreciated that the 4 cylinder embodiment is merely exemplary and the concept of sliding camshaft barrel position sensing may be applied to other multiple cylinder engine configurations, e.g., 5, 6, 8, 9, or 12, without exceeding the scope of the invention.

The engine 10 includes at least one sliding camshaft having at least one camshaft barrel. In the case, the engine 10 includes an intake sliding camshaft 12 and an exhaust sliding camshaft 14. For shifting the position of the intake 12 and exhaust 14 sliding camshafts, at least one actuator 16 is provided in selective communication to the camshafts and commanded on and off by a control module, e.g., engine control module (not shown). Particular to this embodiment, engine 10 includes a plurality of actuators (16*a*-16*f*) with actuators (16*a*-16*d*) being operative for shifting the intake sliding camshaft 12, and actuators (16*e*-16*f*) being operative for shifting the exhaust sliding camshaft 14 when commanded by the controller.

Figure 2:
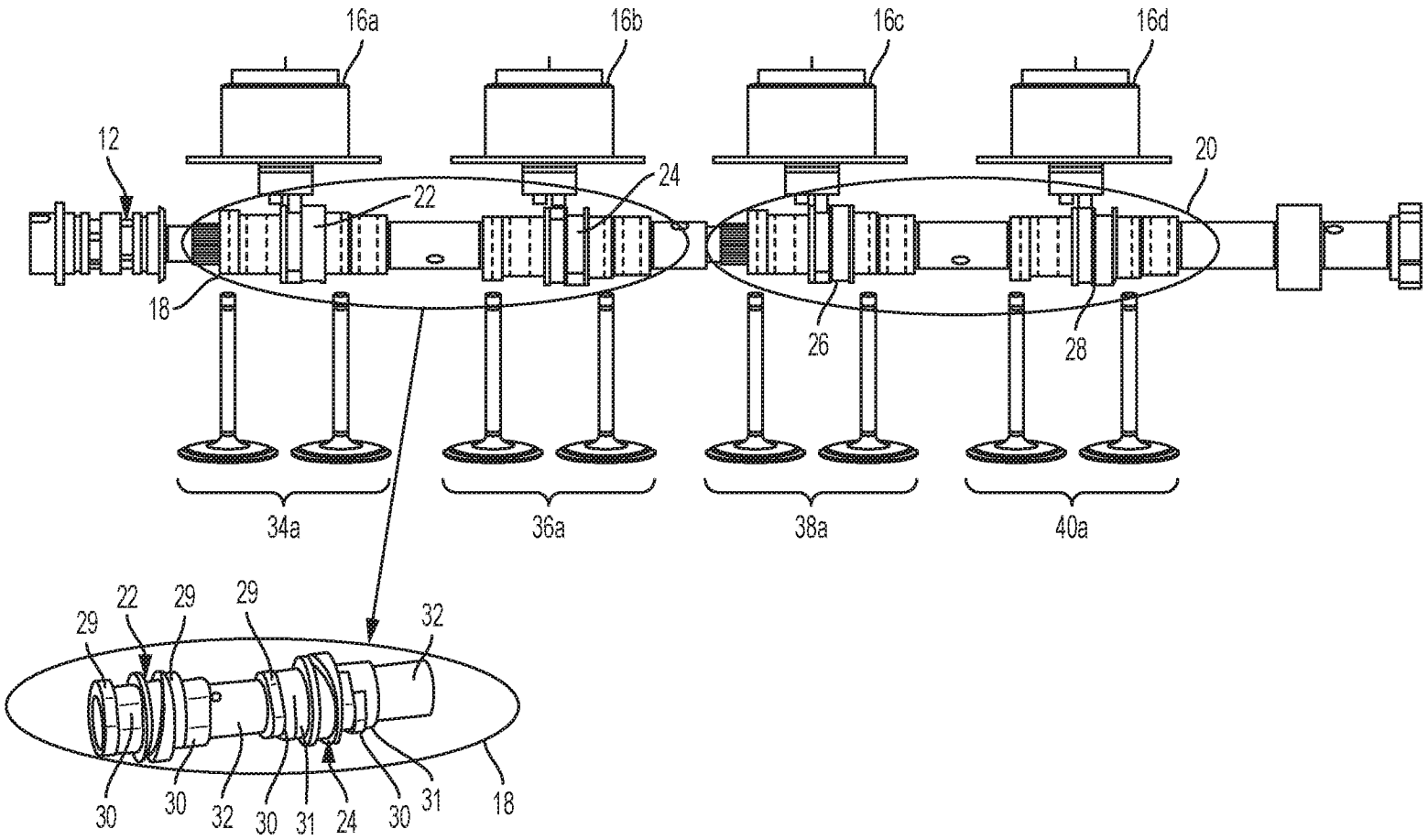
FIG. 2 is an illustration of an intake sliding camshaft configuration with position shifting actuators in accordance with aspects of the exemplary embodiment.

Referring now to FIG. 2, the intake sliding camshaft 12 includes two sliding lobes, 18 and 20. Each sliding lobe (18, 20) includes two camshaft barrels. Camshaft barrels 22 and 24 are fixed on the sliding lobe 18, and the camshaft barrels 26 and 28 are fixed to sliding lobe 20 in accordance with the exemplary embodiment. Referring to the enlarged view of the sliding lobe 18, included is a high lift position 29, a low lift position 30, and a deactivated position 31. The high lift position 29 refers to the air intake valves (34*a*-40*a*) being opened to the maximum position each time the intake sliding camshaft 12 rotates 360° while in this position. The low lift position 30 refers to the air intake valves being opened to a less than maximum position each time the intake sliding camshaft 12 rotates 360° and the deactivated position 31 refers to the air intake valves not be opened at all each time the intake sliding camshaft 12 rotates 360°. The intake sliding camshaft 12 also includes pipe journals 32 for at least maintaining spacing between sliding lobes.

Figure 3:
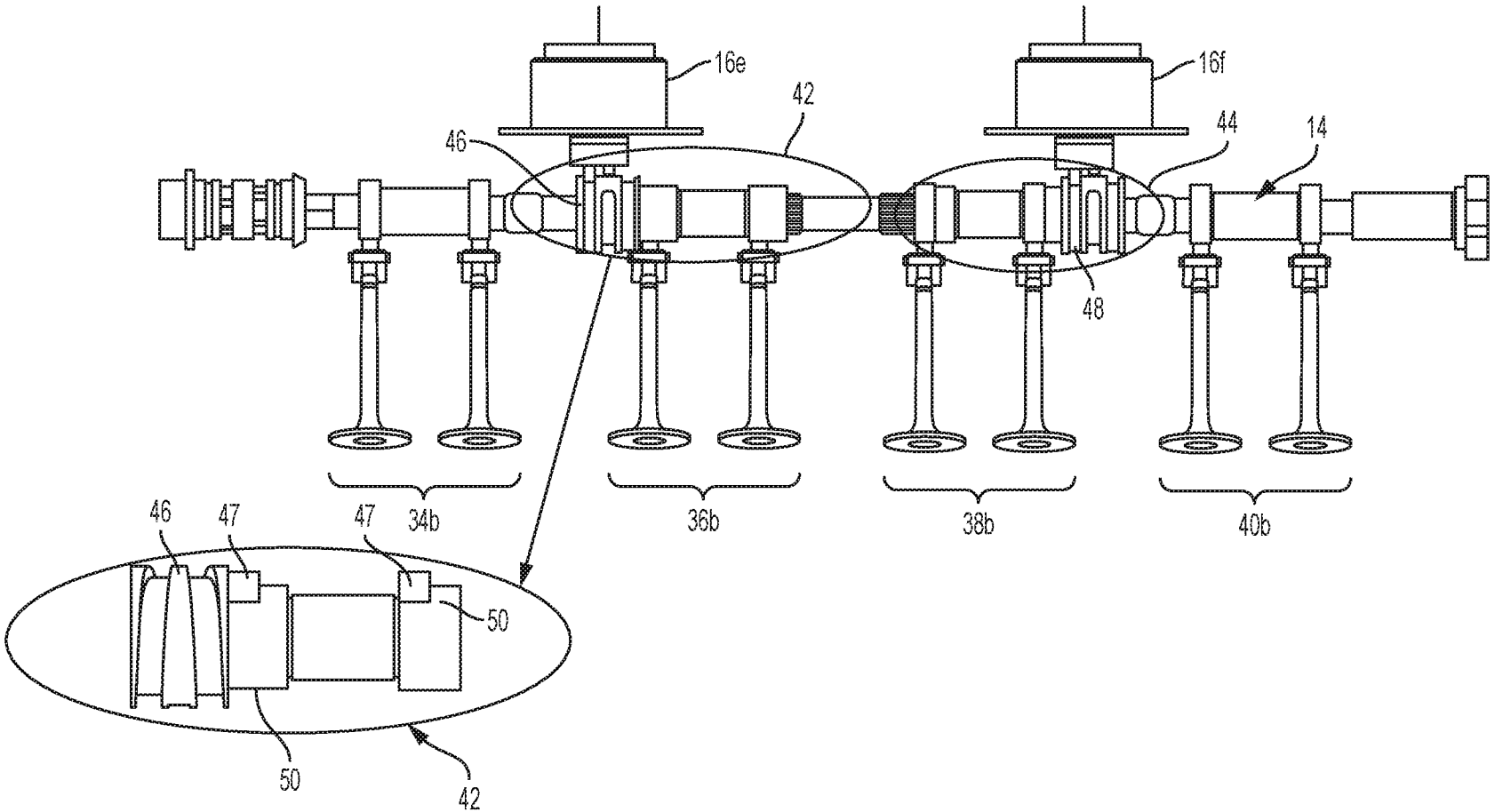
FIG. 3 is an illustration of an exhaust sliding camshaft configuration with position shifting actuators in accordance with aspects of the exemplary embodiment.

Referring now to FIG. 3, the exhaust sliding camshaft 14 includes two sliding lobes 42 and 44. Each sliding lobe (42, 44) includes one camshaft barrel. Camshaft barrel 46 is fixed on the sliding lobe 42, and the camshaft barrel 48 is fixed to sliding lobe 44 in accordance with the exemplary embodiment. Referring to the enlarged view of the sliding lobe 42, included is only a high lift position 47 and a deactivated position 50 in accordance with the exemplary embodiment. As noted above, the high lift position and deactivated position of the sliding exhaust lobe 42 are for opening the air exhaust valves (34*b*-40*b*) to a maximum position or not opening the valves at all, respectively. Valves 34*b* and 40*b* are only operable to be opened to a high lift position while valves 36*b* and 38*b* are operable in a high lift 47 and a deactivated position 50. In accordance with the exemplary embodiment, it requires the activation of at least two position shifting actuators to shift the lobes (18, 20, 422, 44) of the sliding camshafts (12, 14).

Figure 4:
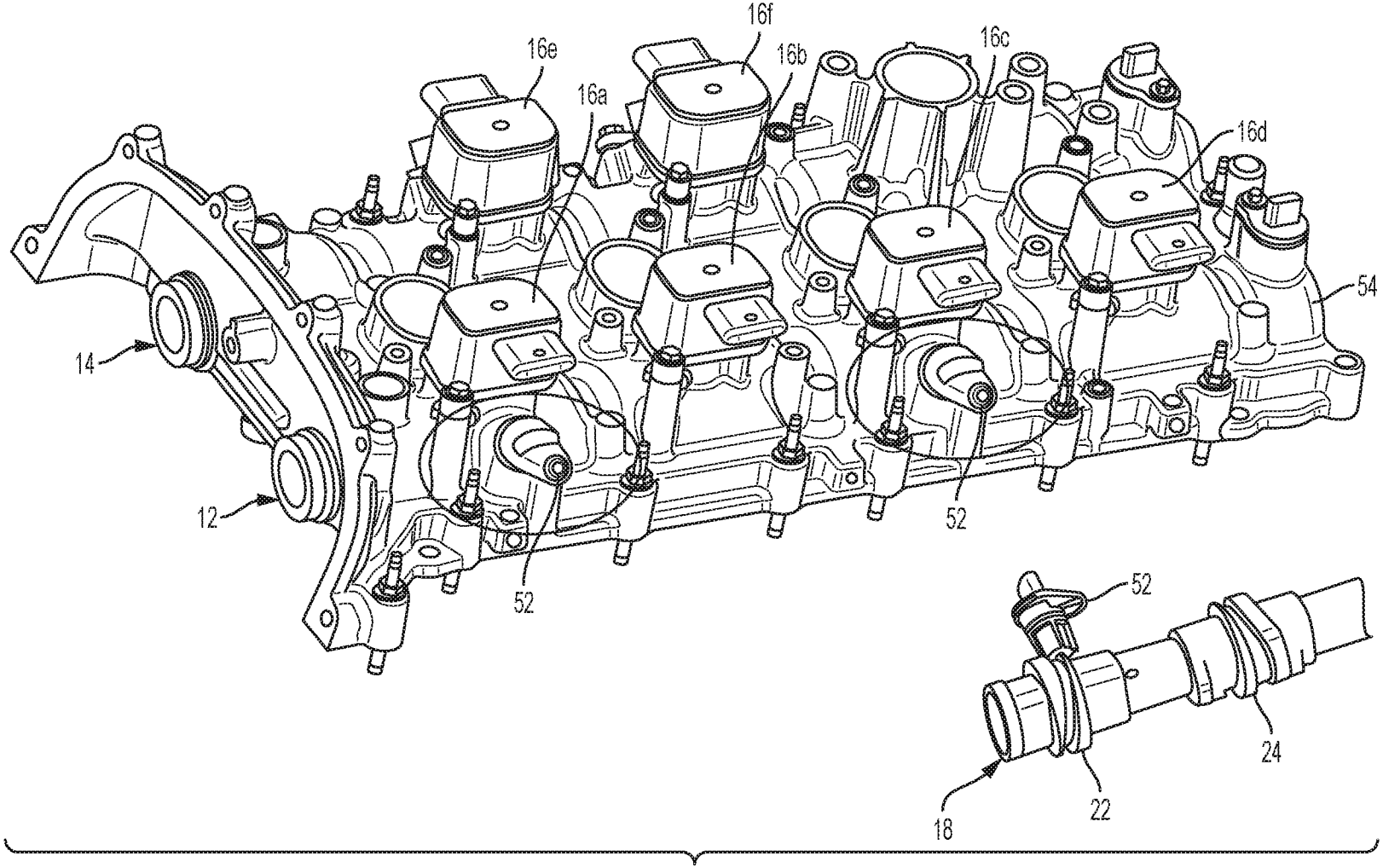
FIG. 4 is an illustration of a sliding camshaft cover with position shifting actuators and detection sensors in accordance with aspects of the exemplary embodiment.

Referring now to FIG. 4, an illustration of a sliding camshaft cover 54 with position shifting actuators (16*a*-16*f*) and position detection sensors 52 in accordance with aspects of the exemplary embodiment is provided. The sliding camshaft cover 54 shrouds the intake 12 and exhaust 14 sliding camshafts as protection from the outside environment containments and retain oil splatter produced by the operation of the engine. The position detection sensors 52 are disposed in the sliding camshaft cover 54 proximate to at least one position shifting slot such that the position of at least one camshaft barrel, e.g., camshaft barrel (22,24), can be detected by the position detection sensor(s) 52 (See 18). The position detection sensors 52 may be of the type that are used for position detection suitable for an engine environment including, but not limited to, a Hall Effect sensor.

Figure 5A:
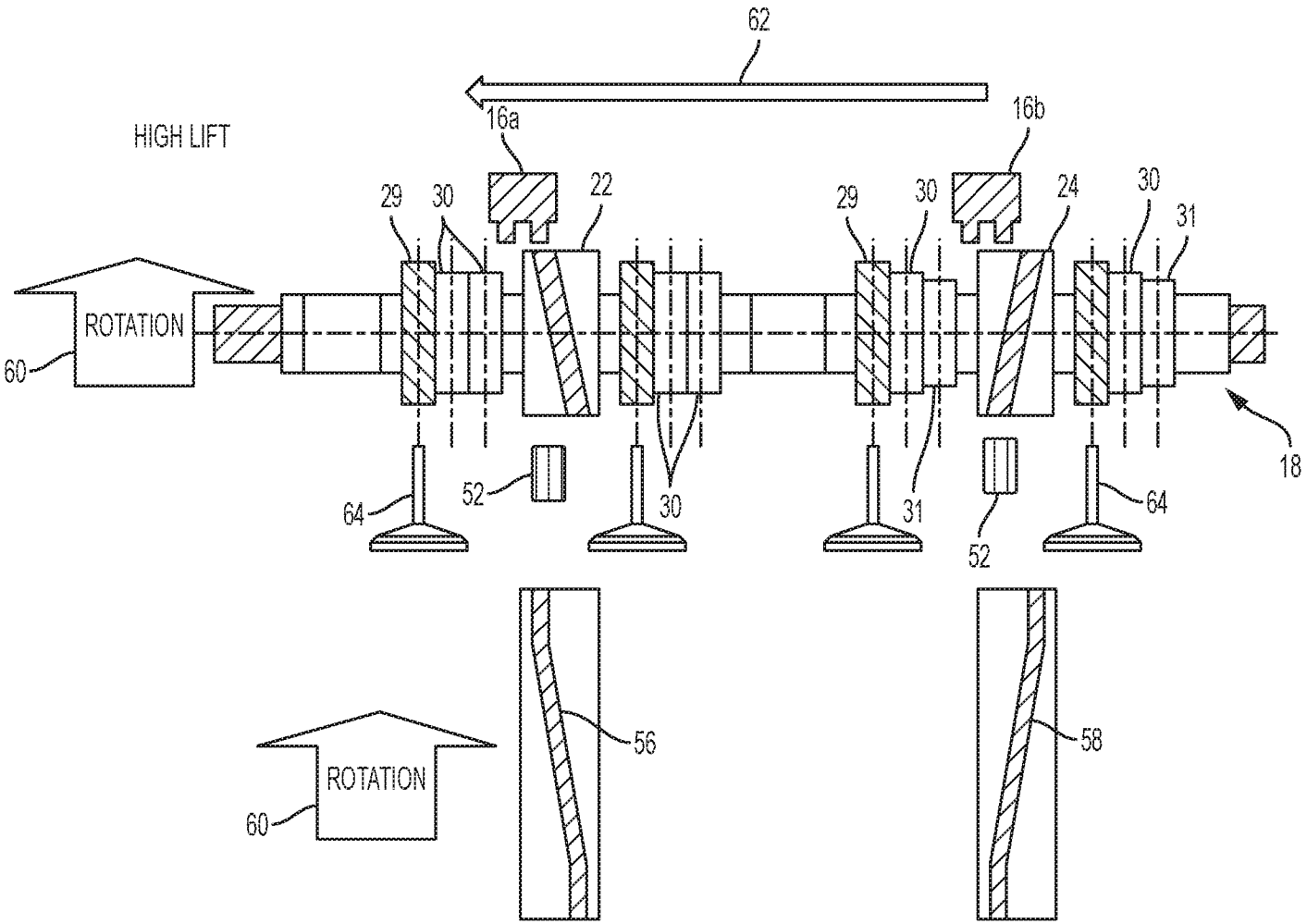
FIG. 5*a* is an illustration of a lobe of an intake sliding camshaft in a high lift position in accordance with aspects of the exemplary embodiment.

Referring to FIG. 5*a*, an illustration of a lobe 18 of an intake sliding camshaft 12 in a high lift position 29 prior to being shifted by the position shifting actuators (16*a*-16*b*) in accordance with aspects of the exemplary embodiment. The lobe 18 includes camshaft barrels 22 and 24 with each barrel having at least one position shifting slot 56 and 58, respectively. The position shifting actuators (16*a*-16*b*) are operative to engage the at least one position shifting slot (56, 58) of the camshaft barrel (22, 24) when commanded on by the engine controller (not shown).

As the intake sliding camshaft 12 rotates towards direction 60, a position shifting actuator 16*a* or 16*b* may be commanded on to engage the at least one position shifting slot 56 or 58, respectively, to cause the lobe 18 of the intake sliding camshaft 12 to shift along the camshaft axis in direction 62. The position detection sensor 52 continuously detects the position of the camshaft barrel (22, 24) and communicates the position to the engine controller.

Figure 5B:
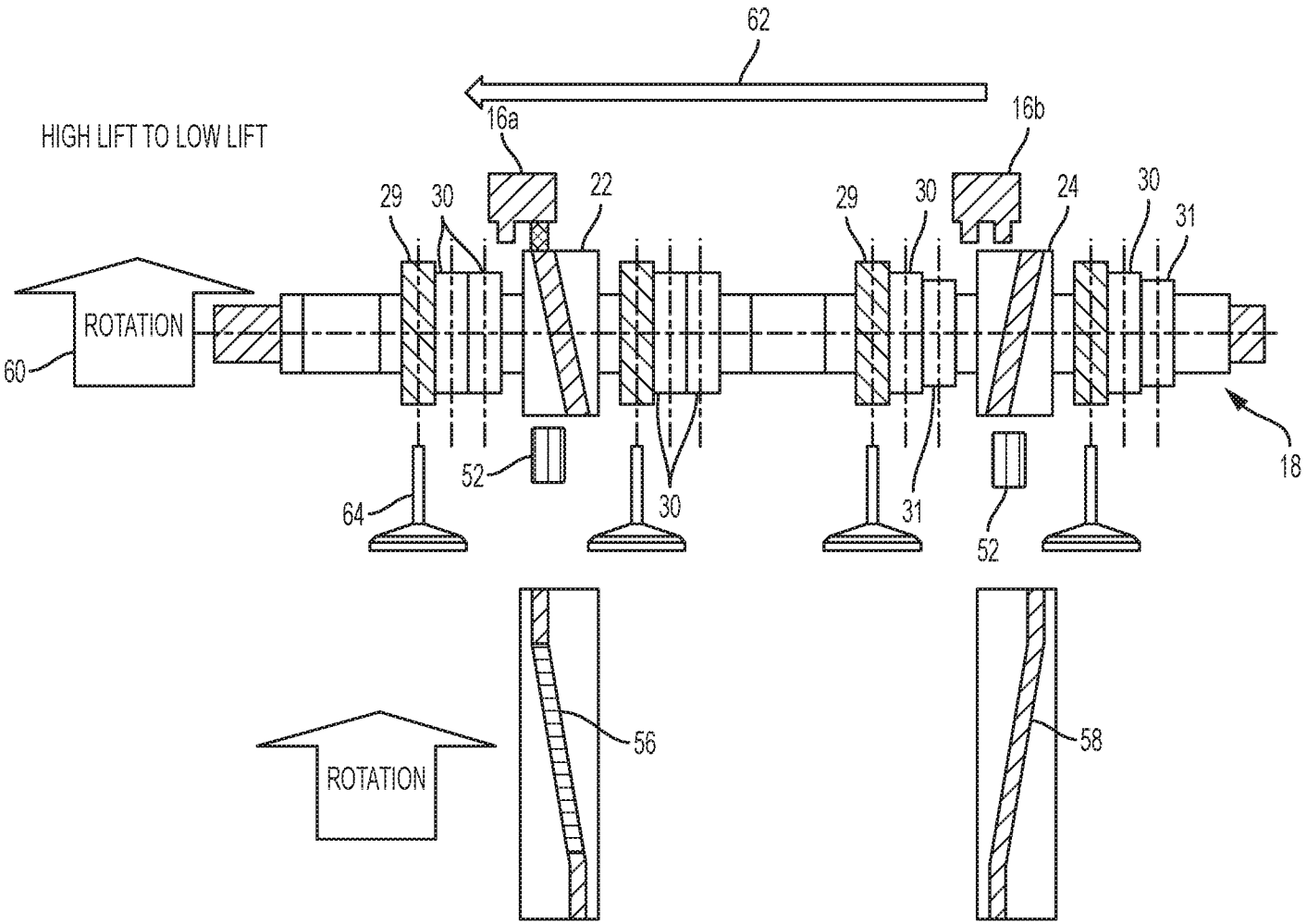
FIG. 5*b* is an illustration of a lobe of an intake sliding camshaft in transition from a high lift to low lift position in accordance with aspects of the exemplary embodiment.
Figure 5C:
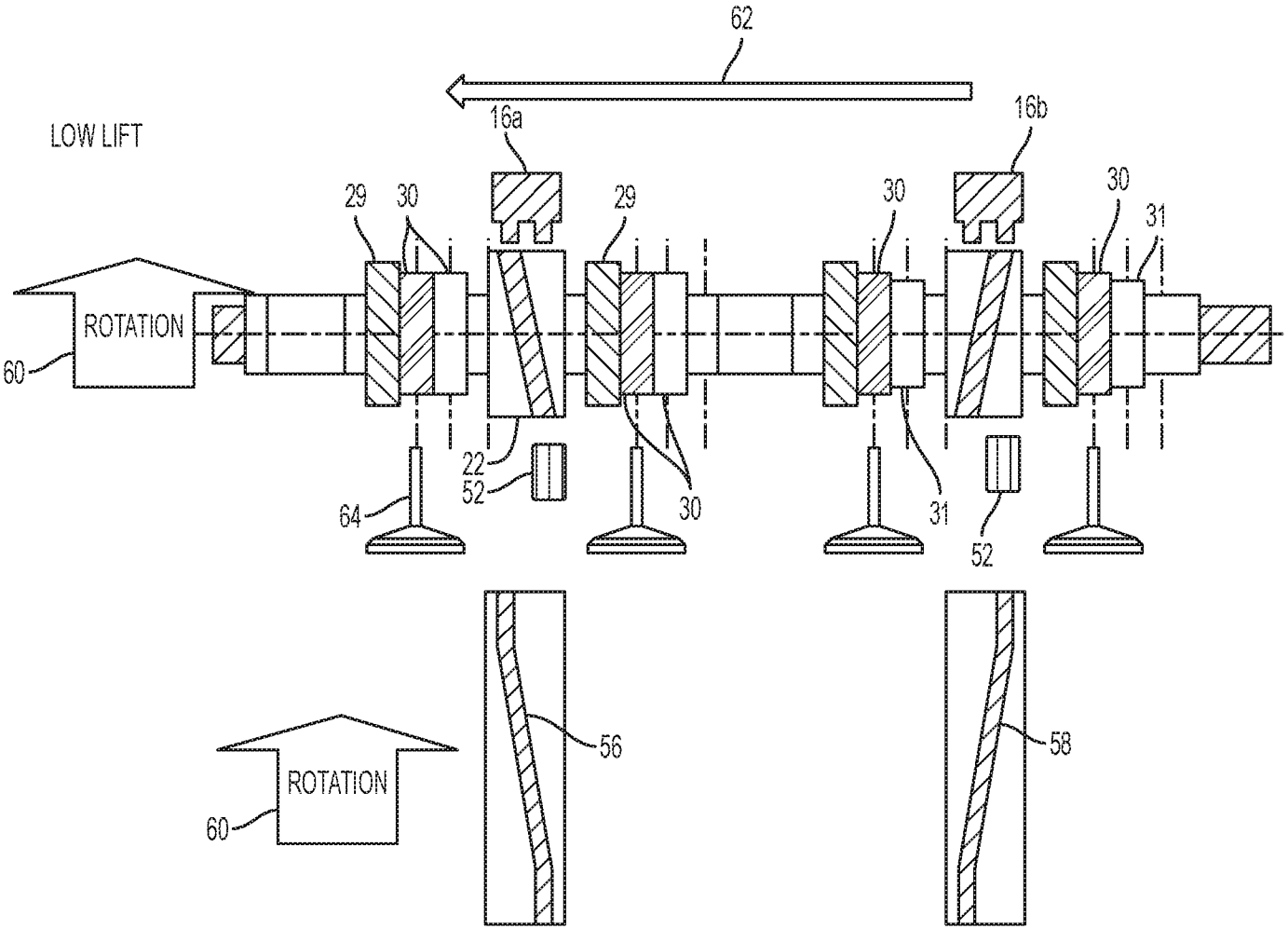
FIG. 5*c* is an illustration of a lobe of an intake sliding camshaft in low lift position in accordance with aspects of the exemplary embodiment.

Referring now to FIGS. 5*b* and 5*c*, when the position shifting actuator 16*a* engages the position shifting slot 56, the lobe 18 shifts along the camshaft axis in the direction 62 such that the intake valves 64 transition from the high lift position 29 to the low lift position 30. In addition, the position detection sensors 52 now detect distinct features on the camshaft barrel (22, 24) indicative of the low lift position 30 which is communicated to the engine controller.

Figure 5D:
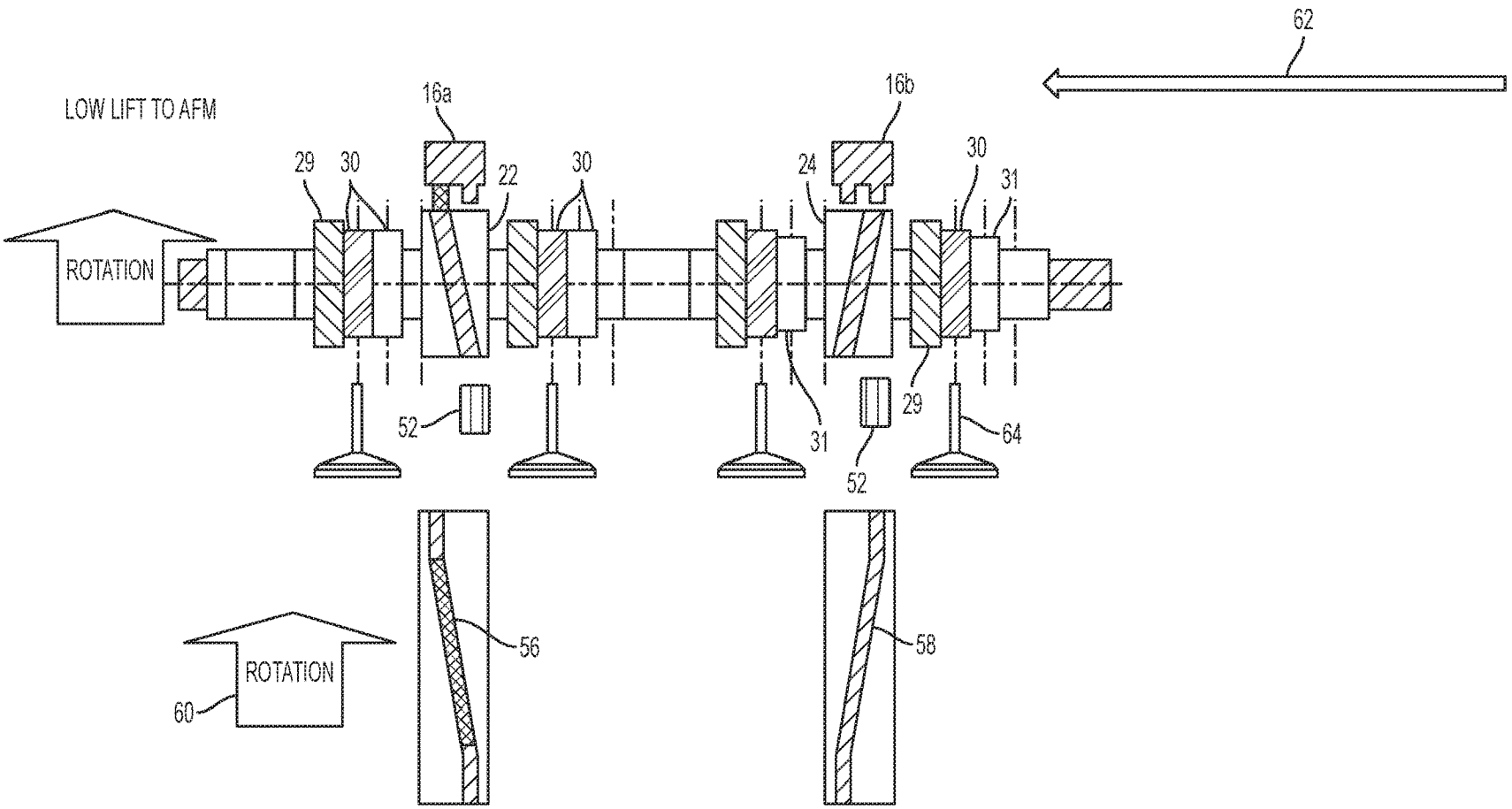
FIG. 5*d* is an illustration of a lobe of an intake sliding camshaft in transition from a low lift to deactivated position in accordance with aspects of the exemplary embodiment.
Figure 5E:
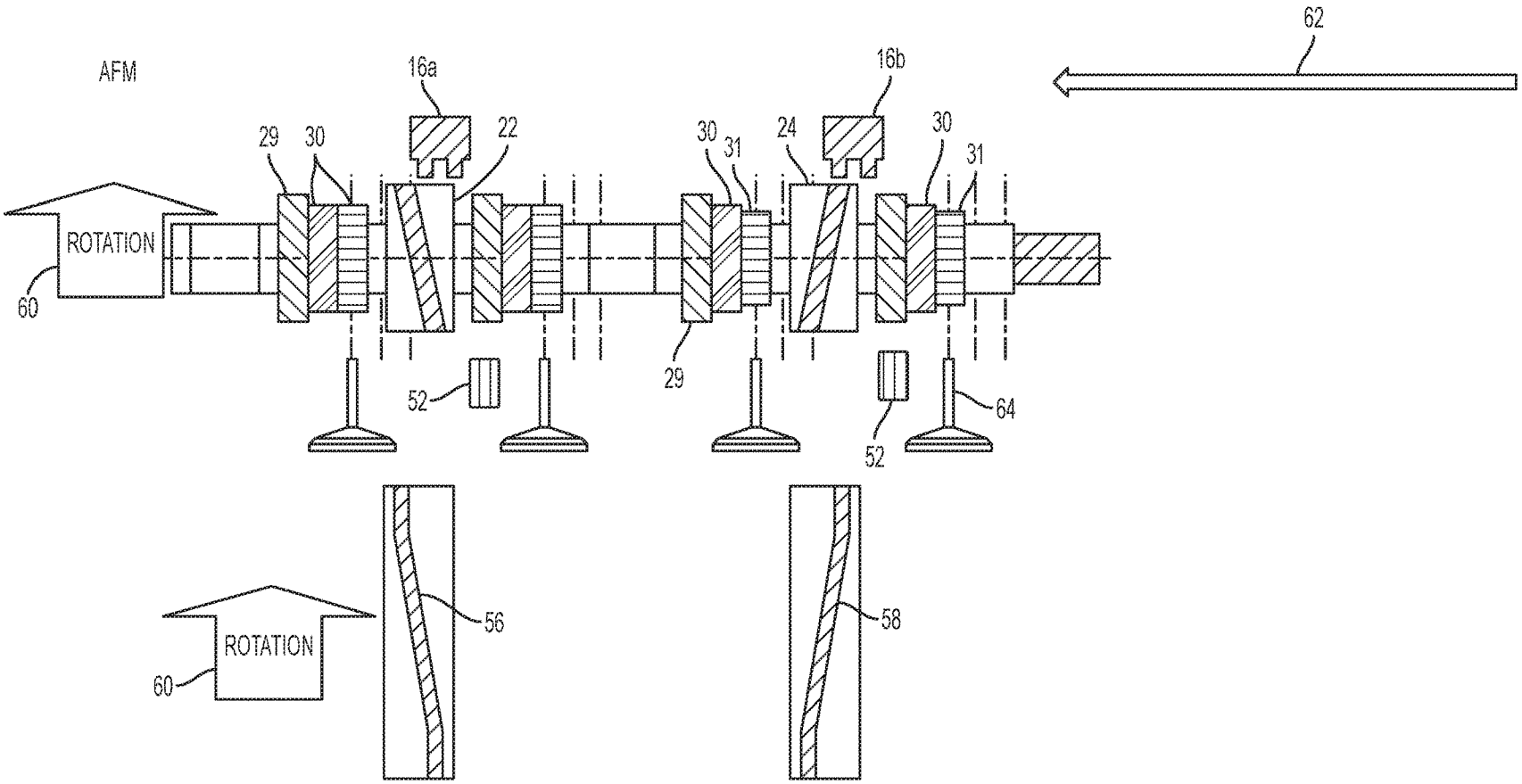
FIG. 5*e* is an illustration of a lobe of an intake sliding camshaft in a deactivated position in accordance with aspects of the exemplary embodiment.

Referring now to FIGS. 5*d* and 5*e*, when the position shifting actuator 16*a* is commanded to engage the position shifting slot 56 again, the lobe 18 is caused to shift along the camshaft axis in the direction 62 such that the intake valves 64 transition from the low lift position 30 to the deactivated position 31. In addition, the position detection sensors 52 now detect distinct features on the camshaft barrel (22, 24) indicative of the deactivated position 31. In accordance with the exemplary embodiment, the position detection sensors 52 detect the high lift position 29 of the lobe 18 rather than distinct features of the camshaft barrel (22, 24) as being indicative of the transition from the low lift position 30 to the deactivated position 31. It is appreciated that the camshaft barrel (22, 24) or the lobe 18 could be constructed to include additional features indicative of a transition to the deactivated position 31 without exceeding the scope of the invention.

Figure 6A:
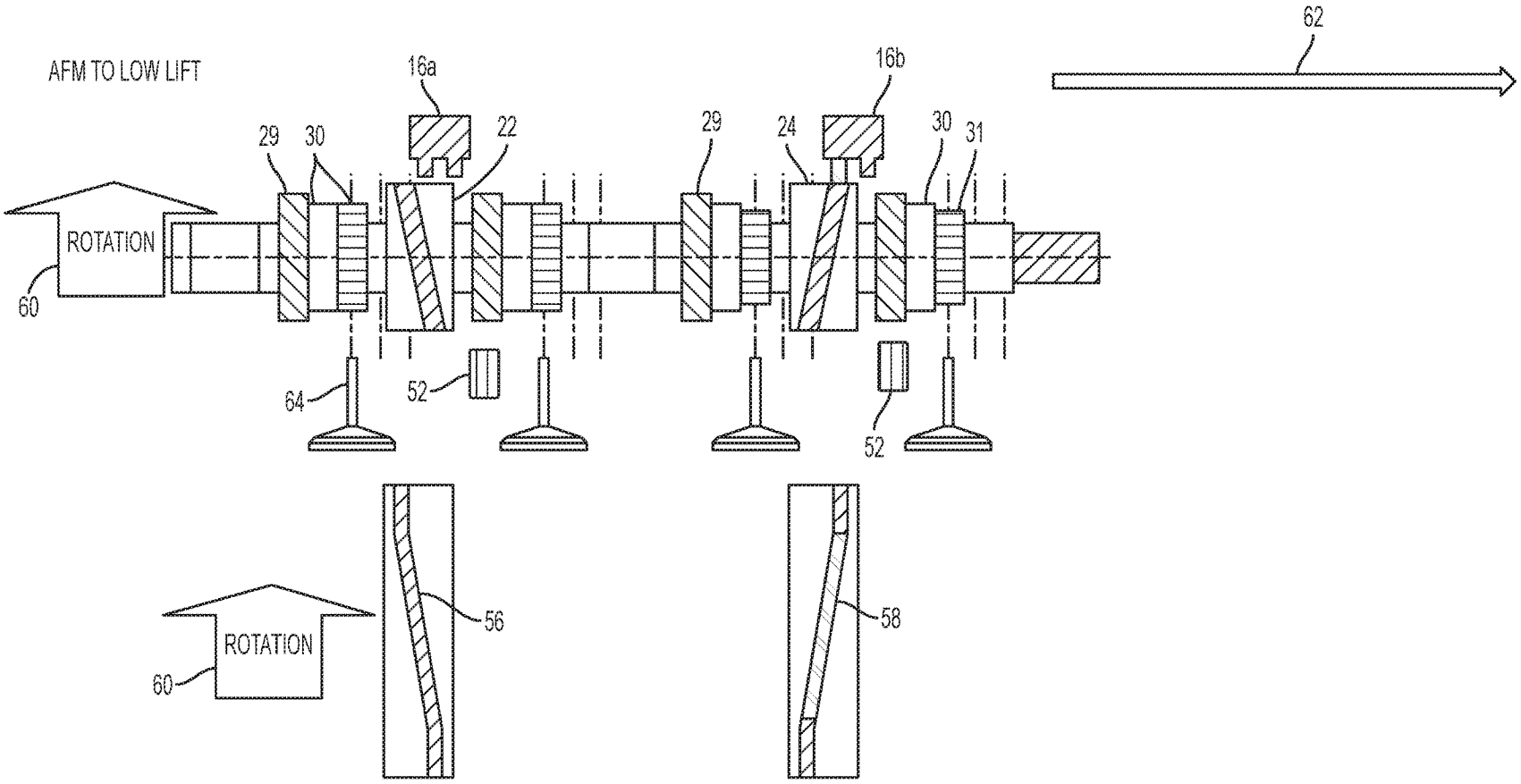
FIG. 6*a* is an illustration of a lobe of an intake sliding camshaft in transition from a deactivated to low lift position in accordance with aspects of the exemplary embodiment.
Figure 6B:
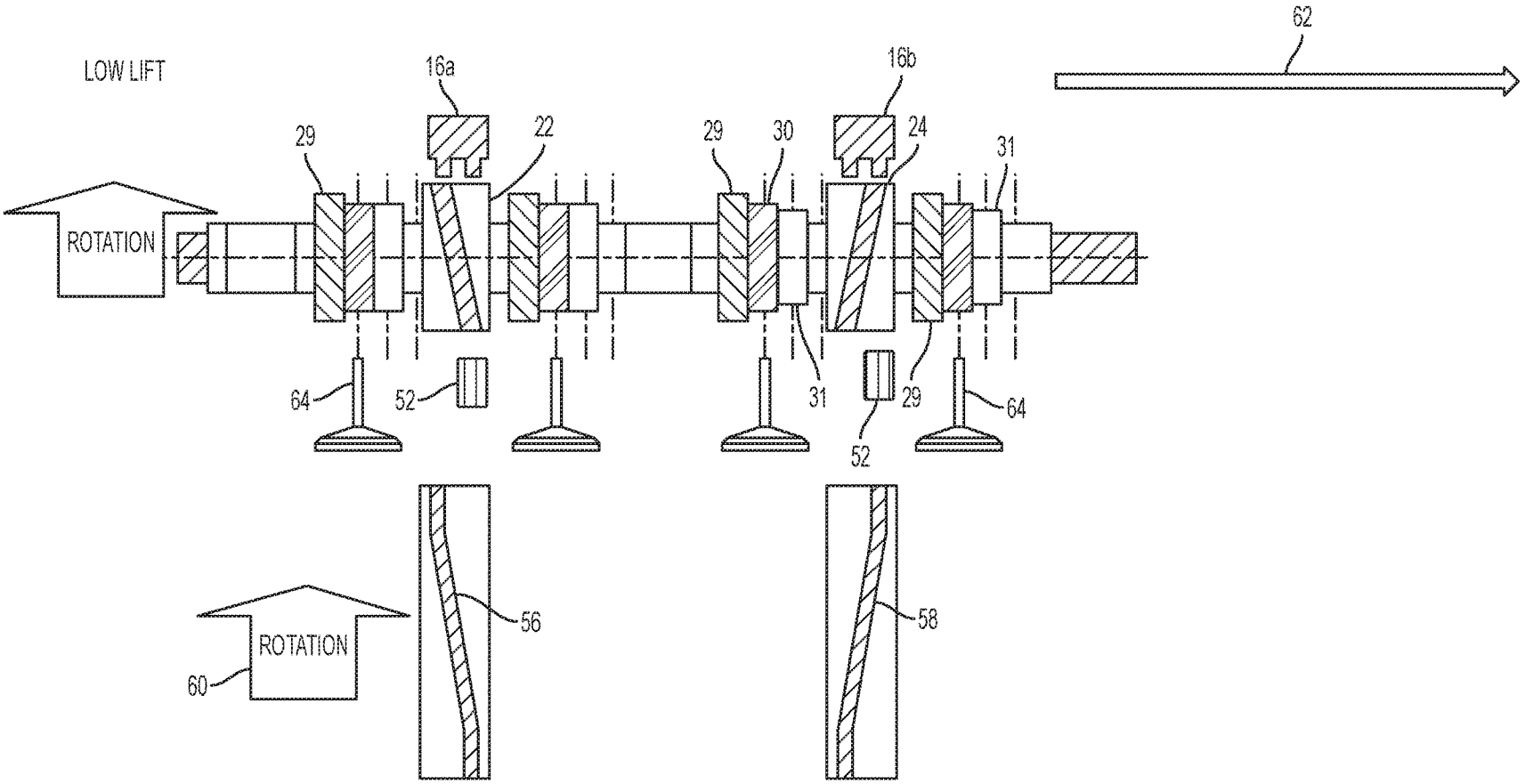
FIG. 6*b* is an illustration of a lobe of an intake sliding camshaft a low lift position in accordance with aspects of the exemplary embodiment.

Referring to FIGS. 6*a* and 6*b*, when the position shifting actuator 16*b* is commanded to engage the position shifting slot 58, the lobe 18 is caused to shift along the camshaft axis in the opposite direction 62 such that the intake valves 64 transition from the deactivated position 31 to the low lift position 30. In addition, the position detection sensors 52 once again detect distinct features on the camshaft barrel (22, 24) indicative of the low lift position 30.

Figure 6C:
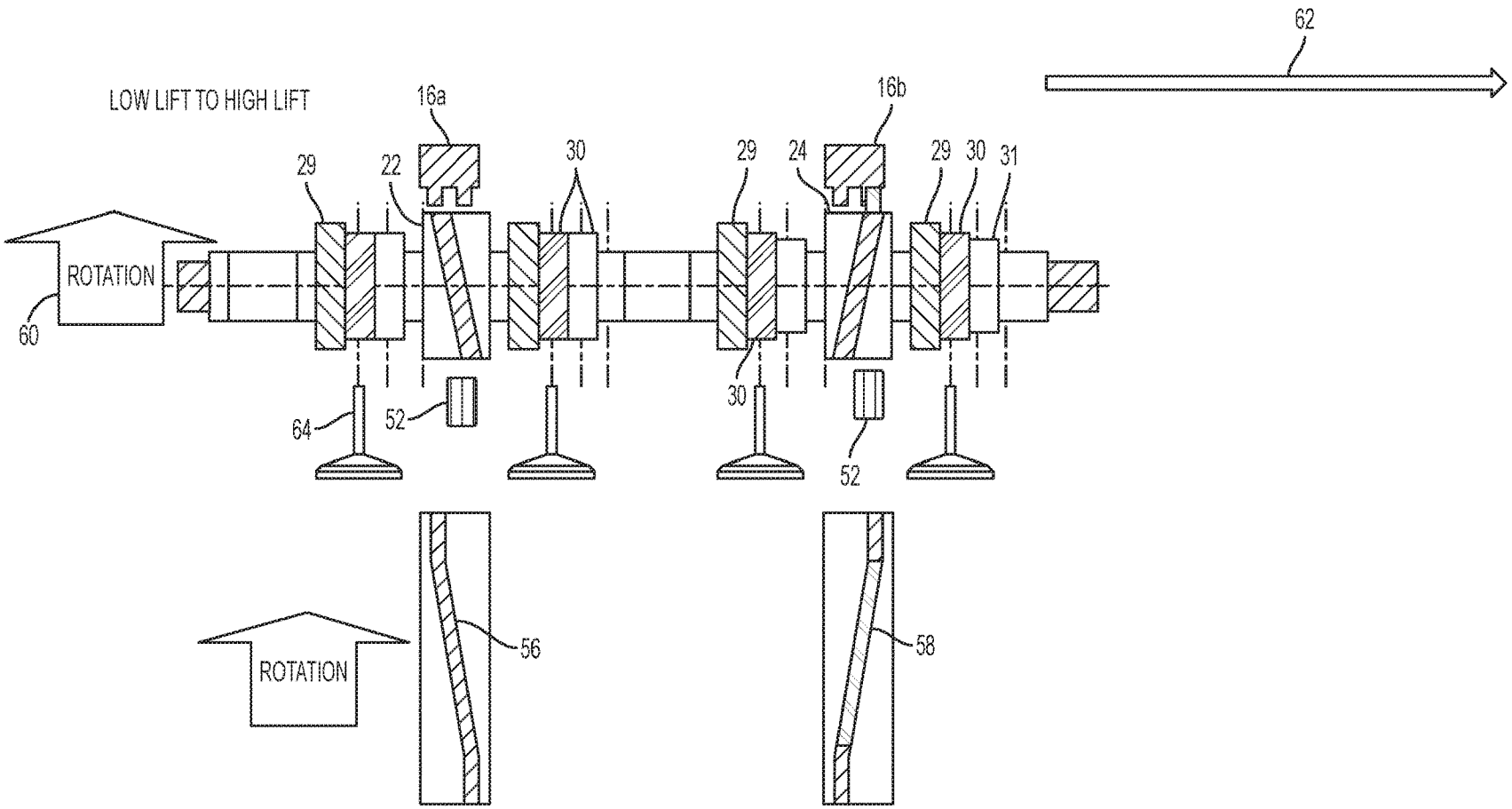
FIG. 6*c* is an illustration of a lobe of an intake sliding camshaft in transition from a low lift to a high lift position in accordance with aspects of the exemplary embodiment.
Figure 6D:
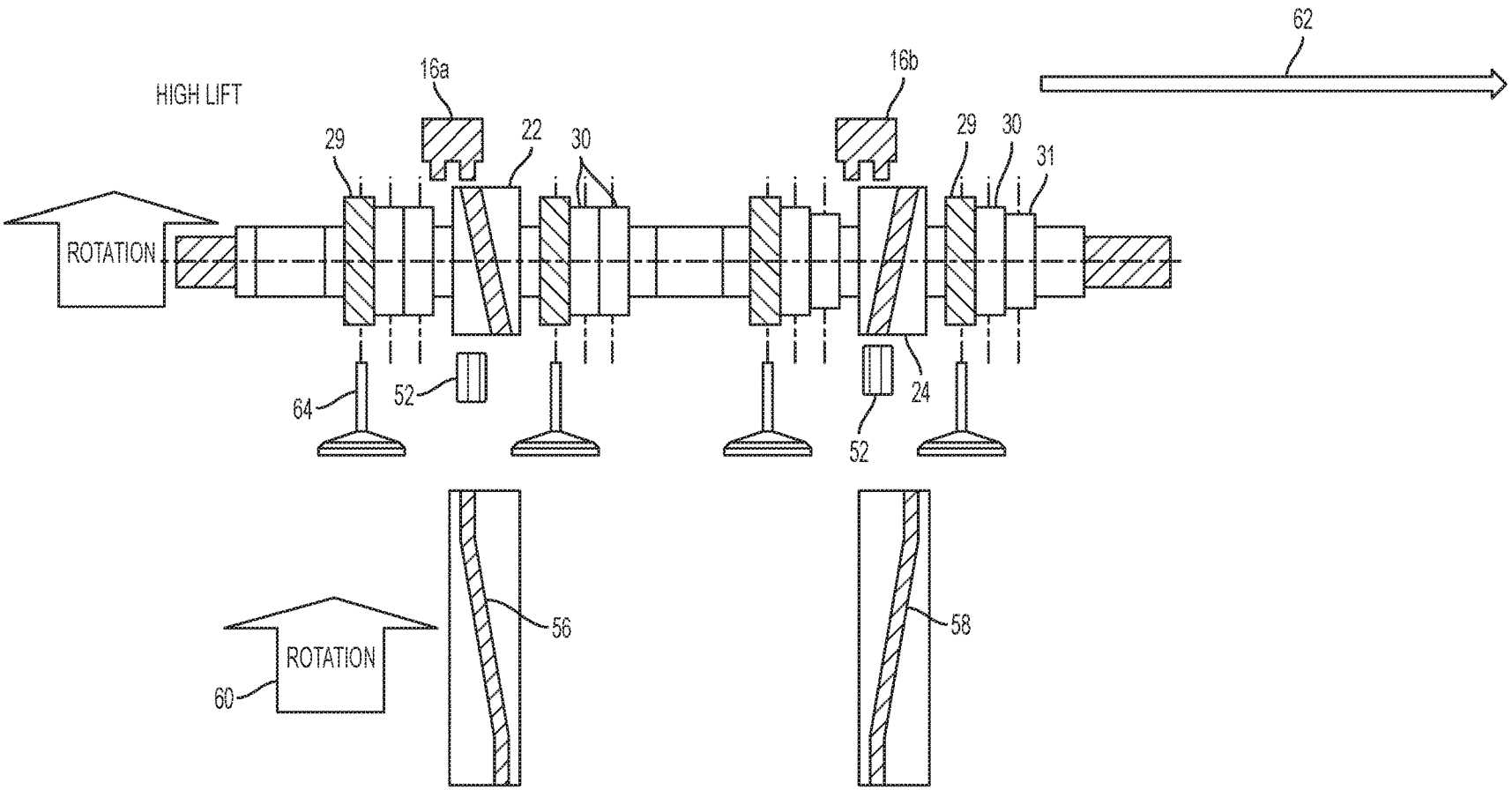
FIG. 6*d* is an illustration of a lobe of an intake sliding camshaft in a high lift position in accordance with aspects of the exemplary embodiment.

Referring now to FIGS. 6*c* and 6*d*, when the position shifting actuator 16*b* is again commanded to engage the position shifting slot 58, the lobe 18 is caused to shift along the camshaft axis in the opposite direction 62 such that the intake valves 64 transition from the low lift position 30 to the high lift position 29. Additionally, the position detection sensors 52 now detect distinct features on the camshaft barrel (22, 24) indicative of the high lift position 29. It is appreciated that the lobes of the intake 12 and exhaust 14 sliding camshafts are shifted into the various positions in a manner consistent with the shifting of lobe 18 in accordance with aspects of the exemplary embodiment.

Figure 7A:
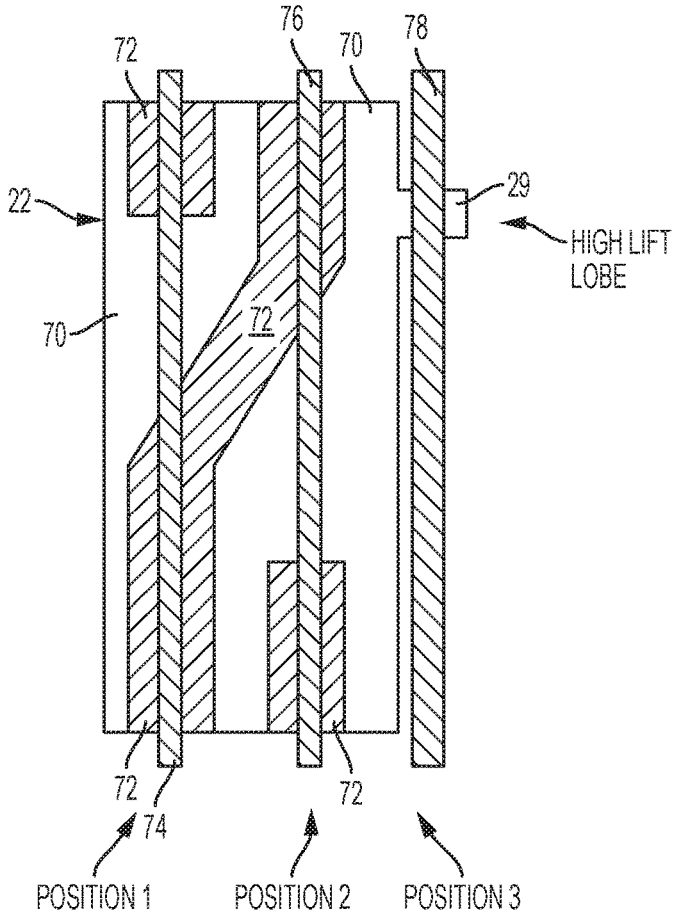
FIG. 7*a* is an illustration of a surface area view of an intake camshaft barrel with position shifting slots and position tracking lines in accordance with aspects of the exemplary embodiment.

Referring to FIG. 7*a*, an illustration of a surface area view of an intake camshaft barrel 22 having a barrel surface 70, position shifting slots 72, and position tracking lines (74, 76, 78) in accordance with aspects of the exemplary embodiment is provided. The camshaft barrel surface 70 is form of metallic material capable of being detected by a suitable sensing device such as, but not limited to, a Hall Effect sensor as the camshaft barrel 22 rotates. It is appreciated that we will use suitable sensing devices to detect unique features of the camshaft barrels for identifying the distinct positions of the sliding camshafts (12,14). Accordingly, when the position detection sensor 52 senses the barrel surface 70 a high output signal sent to the engine controller, and when a position shifting slot 72 is detected a low output signal will be sent to the engine controller.

Figure 7B:
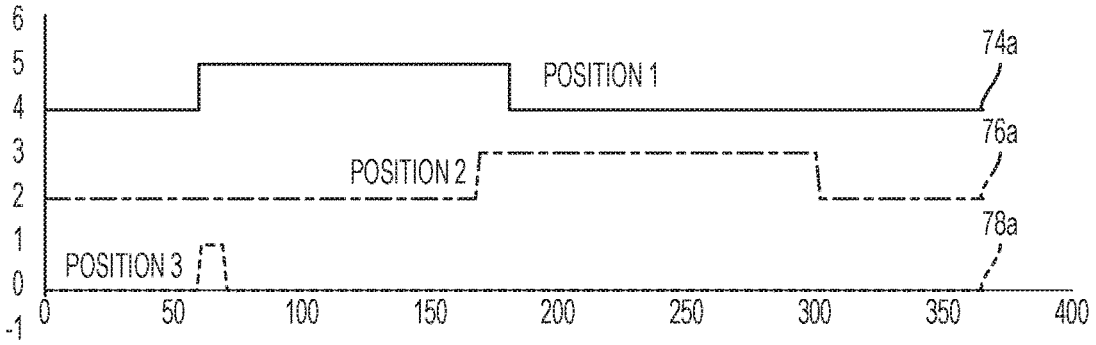
FIG. 7*b* is a graph of position sensor outputs when detecting the position of the intake camshaft barrel in accordance with aspects of the exemplary embodiment.

Referring to FIG. 7*b*, a graph of position detection sensor 52 outputs indicative of the position of the intake camshaft barrel 22 in accordance with aspects of the exemplary embodiment is provided. Graph line 74*a* relates to position tracking line 74 and is indicative of the intake sliding camshaft 12 being in the high lift position 29 which causes the intake valves to be opened to maximum position as the camshaft rotates. Graph line 76*a* relates to position tracking line 76 and is indicative of the intake sliding camshaft 12 being in the low lift position 30 which causes the intake valves to be opened to a level less than the maximum position as the camshaft rotates. Graph line 78*a* relates to position tracking line 78 and is indicative of the intake sliding camshaft 12 being in the deactivated position 31 which causes the intake valves to be in a closed position as the camshaft rotates. Accordingly, the three distinct graph lines (74*a*-78*a*) can be used to at all times determine the position of the intake sliding camshaft or lobes thereof.

Figure 7C:
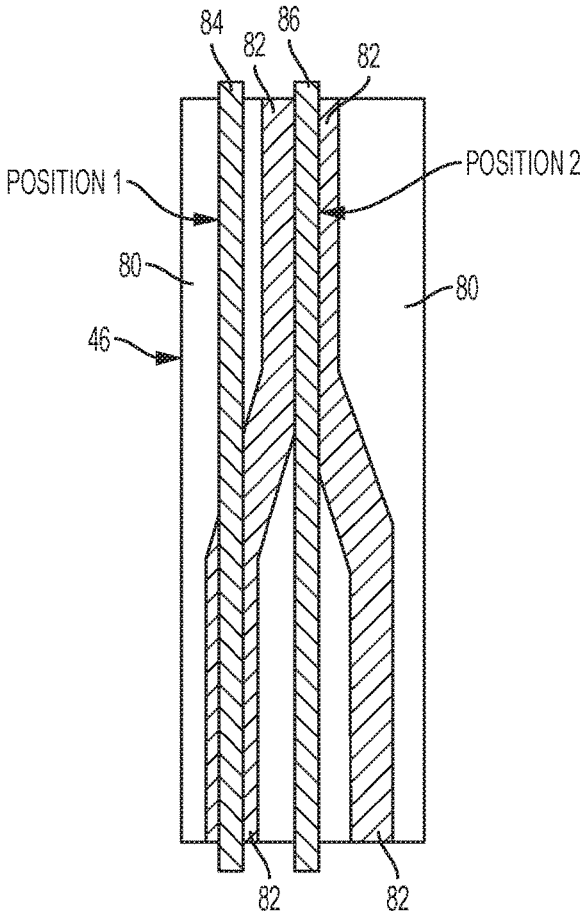
FIG. 7*c* is an illustration of a surface area view of an exhaust camshaft barrel with position shifting slots and position tracking lines in accordance with aspects of the exemplary embodiment.
Figure 7D:
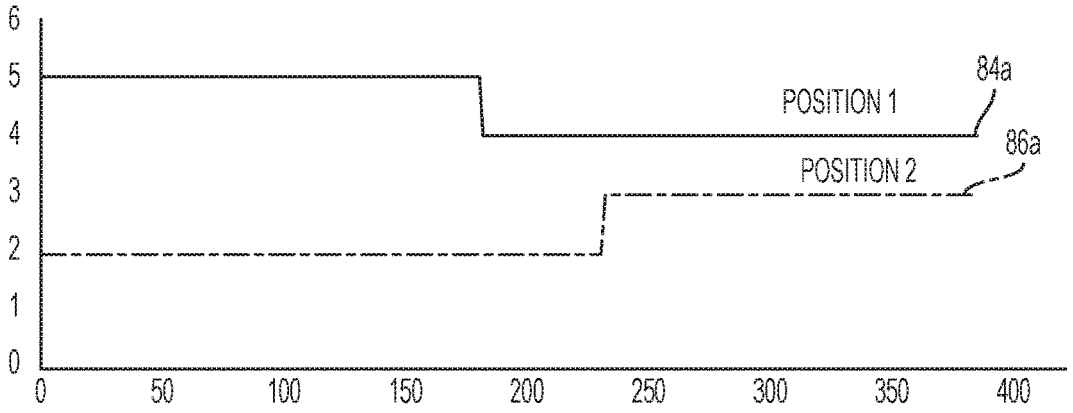
FIG. 7*d* is a graph of position sensor outputs when detecting the position of the exhaust camshaft barrel in accordance with aspects of the exemplary embodiment.

Referring now to FIG. 7*c*, an illustration of a surface area view of an exhaust camshaft barrel 46 having a barrel surface 80, position shifting slots 82, and position tracking lines (84, 86) in accordance with aspects of the exemplary embodiment is provided. FIG. 7*d* presents a graph of position detection sensor 52 outputs indicative of the position of the exhaust camshaft barrel 46. Graph line 84*a* relates to position tracking line 84 and is indicative of the exhaust sliding camshaft 14 being in the high lift position 47 which causes the exhaust valves to be opened to maximum position as the camshaft rotates. Graph line 86*a* relates to position tracking line 86 and is indicative of the exhaust sliding camshaft 12 being in the deactivated position 50 which causes the exhaust valves to be in a closed position as the camshaft rotates. Accordingly, the two distinct graph lines (84*a*-86*a*) can be used to at all times determine the position of the exhaust sliding camshaft or lobes thereof.

Figure 8:
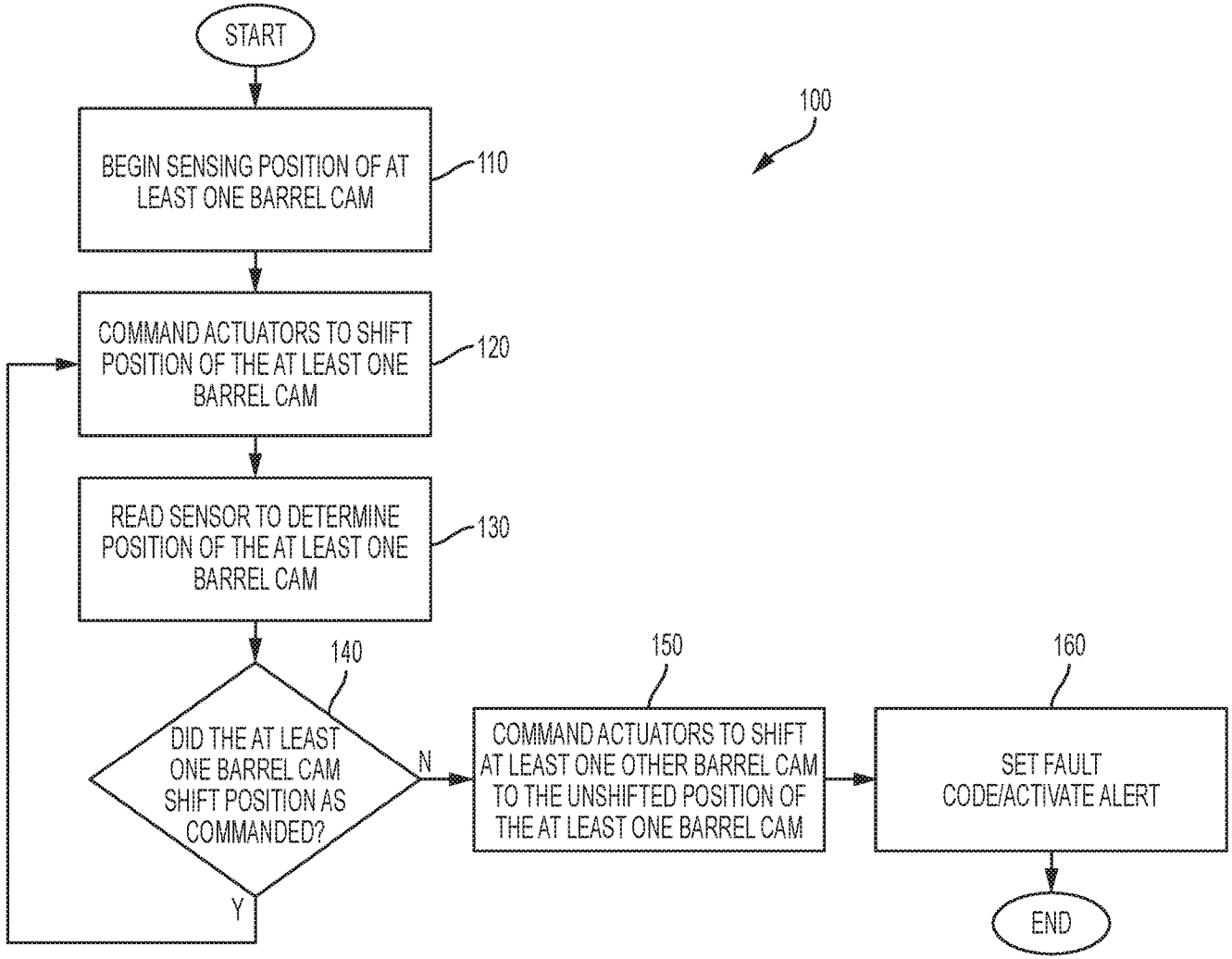
FIG. 8 is an illustration of an algorithm for sliding camshaft barrel position sensing using camshaft barrel features in accordance with the exemplary embodiment.

Referring now to FIG. 8, an illustration of an algorithm 100 for sliding camshaft barrel (12,14) position sensing using camshaft barrel features in accordance with the exemplary embodiment is provided. At block 110, the process begins with rotating at least one sliding camshaft (12,14) having at least one camshaft barrel and detecting the current position of the camshaft barrel. At block 120, the process continues with activating at least one actuator (16*a*-16*f*) for engaging at least one position shifting slot in the at least one camshaft barrel to shift position of the at least one camshaft barrel.

At block 130, the process continues with detecting the shifted position of the at least one camshaft barrel of the at least one sliding camshaft (12,14) using at least one sensor. In accordance with the exemplary embodiment, a Hall Effect sensor is used for detecting the shifted position of the at least one camshaft.

At block 140, the process continues with determining if the at least one camshaft barrel shifted position as commanded. If it is determined that the at least one camshaft barrel shifted position as commanded then the process returns to block 120.

At block 150, the process continues with performing at least one remedial action when the at least one camshaft barrel remains in an unshifted position in response to activating the at least one actuator. In this case, if an actuator was commanded to shift the at least one camshaft barrel position from high lift to low lift, and then the at least one camshaft barrel did not shift as commanded, the remedial action would be to command at least one other camshaft barrel(s) back to the high lift position to be in synchronous with the unshifted camshaft barrel. In other words, the camshaft barrels that in fact shifted position from high lift to low lift as commanded will be shifted back to the low lift position to be in the same state as the unshifted camshaft barrel.

At block 160, further remedial actions may include, but not limited to, setting a fault code in the engine controller, activating an alarm, and/or illuminating indicator lamp to alert the vehicle operator that service is required The detailed description provides those skilled in the art with a convenient road map for implementing the exemplary embodiment or exemplary embodiments. Many modifications and variations will be apparent to those of ordinary skill in the art without departing from the scope and spirit of the invention. While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A system for sensing camshaft barrel position of a sliding camshaft comprising:

at least one sliding camshaft having at least one camshaft barrel;

at least one position shifting slot disposed in the at least one camshaft barrel;

at least one actuator for engaging the at least one position shifting slot and shifting position of the at least one camshaft barrel; and at least one sensor for detecting the shifted position of the at least one camshaft barrel wherein the at least one sliding camshaft is an intake camshaft, and wherein the intake camshaft has two sliding lobes each having two camshaft barrels of the at least one camshaft barrel, and wherein two actuators are used for shifting position of the two sliding lobes of the intake camshaft.

2. The system of claim 1 wherein the at least one sliding camshaft is an exhaust camshaft.

3. The system of claim 2 wherein the exhaust camshaft has two sliding lobes each having one camshaft barrel of the at least one camshaft barrel.

4. The system of claim 3 wherein two actuators are used for shifting position of the two sliding lobes of the exhaust camshaft.

5. The system of claim 2 wherein a position of the exhaust camshaft can be shifted between high lift and deactivated positions.

6. The system of claim 1 wherein the at least one sensor is a Hall Effect sensor.

7. The system of claim 1 wherein a positions of the intake camshaft can be shifted between high lift, low lift and deactivated positions.

8. A method for sensing camshaft barrel position of a sliding camshaft comprising:

rotating at least one sliding camshaft having at least one camshaft barrel;

activating at least one actuator for engaging at least one position shifting slot in the at least one camshaft barrel to shift position of the at least one camshaft barrel;

detecting the shifted position of the at least one camshaft barrel of the at least one sliding camshaft using at least one sensor wherein detecting includes tracking at least one position shifting slot of the at least one camshaft barrel that is indicative of at least one of a high lift, low lift, or deactivated camshaft barrel position; and performing at least one remedial action when the at least one camshaft barrel remains in an unshifted position in response to activating the at least one actuator wherein the remedial action is restoring at least one other camshaft barrel to the unshifted position of the at least one camshaft barrel.

9. The method of claim 8 wherein detecting includes using a Hall Effect sensor for tracking the at least one position shifting slot of the at least one camshaft barrel.

10. The method of claim 8 further comprising setting a fault code and service indicator lamp.

11. The method of claim 8 wherein the step of activating further includes activating two actuators for shifting position of the at least one camshaft barrel.

12. The method of claim 8 wherein the step of rotating further includes an intake sliding camshaft and an exhaust sliding camshaft.

13. The method of claim 12 wherein the step of detecting includes detecting the shifted position of the intake sliding camshaft including high lift, low lift, and deactivated positions.

14. The method of claim 12 wherein the step of detecting includes detecting the shifted position of the exhaust camshaft including high lift and deactivated positions.

* * * * *